US008409378B2

(12) United States Patent
Bley et al.

(10) Patent No.: US 8,409,378 B2
(45) Date of Patent: Apr. 2, 2013

(54) IGNITION CHARGE

(75) Inventors: Ulrich Bley, Fürth (DE); Rainer Hagel, Erlangen (DE); Aleksej Hoschenko, Fürth (DE); Peter Simon Lechner, Oberasbach (DE); Frank Mönius, Cadolzburg (DE)

(73) Assignee: Ruag Ammotec GmbH, Furth (DE)

( * ) Notice: Subject to any disclaimer, the term of this patent is extended or adjusted under 35 U.S.C. 154(b) by 240 days.

(21) Appl. No.: 12/301,887

(22) PCT Filed: May 23, 2007

(86) PCT No.: PCT/EP2007/054996

§ 371 (c)(1), (2), (4) Date: Nov. 21, 2008

(87) PCT Pub. No.: WO2007/135167

PCT Pub. Date: Nov. 29, 2007

(65) Prior Publication Data

US 2011/0041968 A1 Feb. 24, 2011

(30) Foreign Application Priority Data

May 23, 2006 (DE) ..... 10 2006 024 511

(51) Int. Cl.
*D03D 23/00* (2006.01)
*D03D 43/00* (2006.01)

(52) U.S. Cl. ..... 149/19.5; 149/108.2; 149/109.2; 149/109.4

(58) Field of Classification Search ..... 149/19.5, 149/108.2, 109.2, 109.4
See application file for complete search history.

(56) References Cited

U.S. PATENT DOCUMENTS

| | | | | |
|---|---|---|---|---|
| 2,124,568 | A * | 7/1938 | Hale et al. | 149/24 |
| 4,386,979 | A | 6/1983 | Jackson, Jr. | |
| 5,167,736 | A | 12/1992 | Mei et al. | |
| 5,353,707 | A * | 10/1994 | Duguet | 102/290 |
| 5,538,569 | A | 7/1996 | Carter | |
| 5,547,528 | A | 8/1996 | Erickson et al. | |
| 5,610,367 | A | 3/1997 | Erickson et al. | |
| 6,214,138 | B1 | 4/2001 | Canterberry et al. | |
| 2001/0001970 | A1 * | 5/2001 | Hagel et al. | 149/61 |
| 2004/0154713 | A1 * | 8/2004 | Mei et al. | 149/61 |
| 2005/0098248 | A1 | 5/2005 | Khovonskov et al. | |

FOREIGN PATENT DOCUMENTS

| | | |
|---|---|---|
| DE | 37 33 176 | 4/1989 |
| DE | 195 40 278 | 4/1997 |
| DE | 101 64 381 | 5/2003 |
| EP | 1 440 958 | 7/2004 |
| RU | 2 086 523 | 8/1997 |
| RU | 2 121 469 | 11/1998 |
| RU | 2 216 530 | 11/2003 |
| WO | WO 96/07625 | 3/1996 |
| WO | WO 99/48842 | 9/1999 |

OTHER PUBLICATIONS

International Search Report mailed Sep. 3, 2007 in connection with PCT/EP2007/054996; 4 pages; European Patent Office; Rijswijk, Netherlands.
English translation of International Preliminary Report on Patentability in connection with PCT/EP2007/054996; 6 pages.

* cited by examiner

*Primary Examiner* — James McDonough
(74) *Attorney, Agent, or Firm* — Antonelli, Terry, Stout & Kraus, LLP.

(57) ABSTRACT

The invention relates to a lead- and barium-free ignition charge which does not contain any oxidant, and its use.

24 Claims, No Drawings

IGNITION CHARGE

The present invention provides an ignition charge and its use.

The combustion residues of lead-containing and barium-containing compounds used in ignition charges, for example lead styphnate as initial explosive substance and barium peroxide as oxidising agent, have the disadvantage that they are poisonous and ecologically harmful. Furthermore, the poor tribological properties of the combustion residues of barium peroxide have a deleterious effect on the functional capability of the weapon or bolt apparatus.

Whereas lead styphnate could be replaced without any problem by for example diazodinitrophenol or salts of dinitrobenzofuroxanate, although the zinc peroxide proposed in EP-A-0 031 045 as a substitute for barium peroxide is indeed far less harmful from the health and ecological aspect, nevertheless its combustion residues are also corrosive and adversely affect the functioning of the materials of the weapon or bolt apparatus.

The object of the present invention is to provide an ignition charge that overcomes the disadvantages of the prior art, is free from lead and barium, has a high functional reliability and/or whose combustion residues do not interfere in the functioning of the weapon or bolt apparatus.

According to the invention this object is surprisingly achieved by the features of the main claim. Preferred embodiments are disclosed in the sub-claims.

In particular it has surprisingly been found that the object is achieved by a lead-free and barium-free ignition charge that contains no oxidising agent, in particular no peroxide. Apart from the initial explosive substance, sensitiser and friction agent, the ignition charge according to the invention can optionally contain one or more additives.

In particular the present invention provides a lead-free and barium-free ignition charge without any oxidising agent, and which contains an initial explosive substance or a plurality of initial explosive substances. In order to improve the tribological properties of the combustion residues this ignition charge can contain boron and/or boron derivatives. The ignition charge can for example be used in cartridges with edge-firing ignition or cartridges for industrial purposes, for instance for bolt apparatuses or to stun cattle.

Oxidising agents in the context of the invention are understood to denote substances whose oxygen balance is positive. Examples of such substances are the nitrates of the alkali and/or alkaline-earth metals and/or ammonium, the perchlorates of the alkali and/or alkaline-earth metals and/or ammonium, the peroxides of the alkaline-earth metals and/or zinc, or mixtures of two or more of these substances.

According to the invention an ignition charge is preferred that contains, apart from the initial explosive substance, sensitiser and friction agent and optionally one or more additives, in addition a boron component, for example boron and/or boron derivatives such as boron nitride and/or zirconium boride. Such an ignition charge ensures a high functional reliability and a long service life of the mechanically stressed parts of the weapon or bolt apparatus.

The reason for this is in particular the formation of metal boroxides, in particular if the potassium dinitrobenzofuroxanate of potassium borate is used, which has a positive effect on the tribological properties of the combustion residues. Also, boron nitride acts as a lubricant in the combustion residues.

The use of boron or boron derivatives in ignition charges is known per se, for example from WO-A-0140144. However, in the prior art boron or boron derivatives are always employed in conjunction with oxidising agents, and compared to these oxidising agents serve as reducing agents. The boron or boron derivatives in these ignition charges therefore do not contribute to improving the tribological properties of the combustion residues.

According to the invention it is particularly preferred if the boron component serving as forming agent of metal boroxides is employed in a stoichiometric amount with respect to the formation of alkali metal and/or alkaline-earth metal borates in the combustion residues.

In a further preferred embodiment according to the invention the ignition charge contains, apart from the initial explosive substance, sensitiser and friction agent and optionally one or more additives, also a boron component, for example boron and/or boron derivatives such as boron nitride and/or zirconium boride, and one or more substances that are suitable for improving and characterising the smell and that withstand the thermal stress during the ignition and discharge. An example of such a smell-improving substance is vanillin.

According to the invention the following (individually or as mixtures) can be used as initial explosive substance:

Diazodinitrophenol, salts of dinitrobenzofuroxane, in particular potassium dinitrobenzofuroxanate, 1-(2,4,6-trinitrophenyl)-5-(1-(2,4,6-trinitrophenyl)-1H-tetrazol-5-yl)-1H-tetrazole (abbreviation: picrazole).

According to the invention the following (individually or as mixtures) can be used as sensitiser:

Tetrazene, diazodinitrophenol.

According to the invention the following (individually or as mixtures) can be used as friction agent:

Glass spheres, glass beads, glass powder, calcium silicide, coke powder.

According to the invention the following can be used as additives:

1. Reducing agents (individually or as mixtures): aluminium, titanium, titanium hydride, zirconium, zirconium hydride, silicon, graphite, activated charcoal, carbon black.
2. Auxiliary substances (individually or as mixtures): nitrocellulose ball powder, silicates, silica gels, preferably nitrocellulose ball powder.
3. Binders (individually or as mixtures): adhesin, cellulose as well as its derivatives, polyvinylbutyrals, polynitropolyphenylene, polynitrophenyl ether, plexigum, gum arabic, dextrins, polyvinyl acetate and copolymers, preferably adhesin.
4. Secondary explosives (individually or as mixtures): hexogen, octogen and nitropenta.

The ignition chargers according to the invention are produced according to processes known from the prior art, for example by kneading the water-moist mixture or screening the dry mixture. The metering of the water-moist composition is likewise carried out according to methods known from the prior art, for example by feeding the composition through perforated plates, by dispensing or by extrusion.

The present invention provides in particular:

an ignition charge that is free from lead and barium;

an ignition charge that is free from peroxides;

an ignition charge that is free from oxidising agents;

an ignition charge that contains one or more initial explosive substances, one or more sensitisers and/or one or more friction agents;

an ignition charge that contains at least one initial explosive substance, a sensitiser and a friction agent;

an ignition charge that contains apart from initial explosive substance, sensitiser and friction agent, also a boron component, preferably boron and/or boron derivatives such as boron nitride and/or zirconium borides;

an ignition charge that contains apart from initial explosive substance, sensitiser and friction agent, also one or more additives;

an ignition charge that contains apart from initial explosive substance, sensitiser, friction agent and one or more additives, also a boron component, preferably boron and/or boron derivatives such as boron nitride and/or zirconium boride;

an ignition charge in which the initial explosive substance is one or more of the following substances: diazodinitrophenol, salts of dinitrobenzofuroxane, in particular potassium dinitrobenzofuroxanate, 1-(2,4,6-trinitrophenyl)-5-(1-(2,4,6-trinitrophenyl)-1H-tetrazol-5-yl)-1H-tetrazole (abbreviation: picrazole);

an ignition charge in which the proportion of the initial explosive substance in the final ignition charge is 30 to 70 wt. %, preferably 35 to 65 wt. %, particularly preferably 38 to 58 wt. %;

an ignition charge in which the sensitiser is one or more of the following substances: tetrazene, diazodinitrophenol, preferably tetrazene;

an ignition charge in which the proportion of the sensitiser in the final ignition charge is 1 to 12 wt. %, preferably 2 to 10 wt. %;

an ignition charge in which the friction agent is one or more of the following substances: glass spheres, glass beads, glass powder, calcium silicide, coke powder;

an ignition charge in which the proportion of the friction agent in the final ignition charge is 10 to 40 wt. %, preferably 20 to 35 wt. %, particularly preferably 20 to 32 wt. %;

an ignition charge in which the proportion of the boron component is 0.01 to 5 wt. %, preferably 0.05 to 3 wt. %, particularly preferably 0.1 to 2.5 wt. %;

an ignition charge in which the boron component is used in a stoichiometric amount, with respect to the formation of alkali metal and/or alkaline-earth metal borates in the combustion residues;

an ignition charge in which as additives there can be used one or more reducing agents, one or more auxiliary substances, one or more binders, one or more secondary explosives and/or one or more smell-improving substances, or mixtures of two or more of these substances;

an ignition charge in which as reducing agent there can be used aluminium, titanium, titanium hydride, zirconium, zirconium hydride, silicon, graphite, activated charcoal, carbon black or mixtures of two or more of these substances;

an ignition charge in which the proportion of the reducing agent in the final ignition charge is 0 to 20 wt. %, preferably 1 to 19 wt. %, particularly preferably 5 to 15 wt. %;

an ignition charge in which as auxiliary substance there can be used nitrocellulose ball powder, silicates, silica gels, preferably nitrocellulose ball powder, or mixtures of two or more of these substances;

an ignition charge in which the proportion of the auxiliary substance in the final ignition charge is 2 to 45 wt. %, preferably 5 to 40 wt. %, particularly preferably 9 to 36 wt. %;

an ignition charge in which as binder there can be used adhesin, cellulose as well as its derivatives, polyvinylbutyrals, polynitropolyphenylene, polynitrophenyl ether, plexigum, gum arabic, dextrins, polyvinyl acetate or copolymers, preferably adhesin, or mixtures of two or more of these substances;

an ignition charge in which the proportion of the binder in the final ignition charge is 0.2 to 5 wt. %, preferably 0.5 to 3 wt. %;

an ignition charge in which as secondary explosive there can be used hexogen, octogen, nitropenta or mixtures of two or more of these substances;

an ignition charge in which the proportion of the secondary explosive in the final ignition charge is 0 to 20 wt. %, preferably 1 to 19 wt. %, particularly preferably 5 to 15 wt. %;

an ignition charge that contains a smell-improving substance, particularly vanillin;

an ignition charge in which the proportion of the smell-improving substance in the final ignition charge is 0 to 10 wt. %, preferably 0.1 to 9 wt. %, particularly preferably 1 to 5 wt. %;

use of the ignition charge according to the invention in cartridges with edge-firing ignition;

use of the ignition charge according to the invention in cartridges with edge-firing ignition, preferably for industrial purposes, particularly preferably for bolt apparatuses or for stunning cattle.

The invention is illustrated in more detail hereinafter by several examples of implementation, without being restricted thereto; all data given as percent (%) should be understood as weight percent (wt. %):

EXAMPLE 1

Ignition Charge 1

| | |
|---|---|
| Diazodinitrophenol | 44.0% |
| Potassium dinitrobenzofuroxanate | 10.0% |
| Tetrazene | 3.0% |
| Glass beads | 32.0% |
| Nitrocellulose ball powder | 9.7% |
| Adhesin | 1.0% |
| Boron | 0.2% |
| Boron nitride | 0.1% |

EXAMPLE 2

Ignition Charge 2

| | |
|---|---|
| Diazodinitrophenol | 43.0% |
| Picrazole | 10.0% |
| Tetrazene | 4.0% |
| Glass powder | 32.0% |
| Nitrocellulose ball powder | 9.7% |
| Adhesin | 1.0% |
| Boron nitride | 0.3% |

EXAMPLE 3

Ignition Charge 3

| | |
|---|---|
| Diazodinitrophenol | 50.0% |
| Tetrazene | 8.0% |
| Glass powder | 30.0% |
| Nitrocellulose ball powder | 9.0% |
| Adhesin | 2.0% |
| Calcium silicide | 1.0% |

EXAMPLE 4

Ignition Charge 4

| | |
|---|---|
| Diazodinitrophenol | 35.0% |
| Potassium dinitrobenzofuroxanate | 10.0% |
| Tetrazene | 8.0% |
| Glass powder | 30.0% |
| Nitrocellulose ball powder | 15.0% |
| Adhesin | 2.0% |

EXAMPLE 5

Ignition Charge 5

| | |
|---|---|
| Diazodinitrophenol | 31.0% |
| Potassium dinitrobenzofuroxanate | 7.3% |
| Tetrazene | 2.1% |
| Glass powder | 22.8% |
| Nitrocellulose ball powder | 35.6% |
| Adhesin | 0.9% |
| Boron | 0.2% |
| Boron nitride | 0.1% |

EXAMPLE 6

Ignition Charge 6

| | |
|---|---|
| Potassium dinitrobenzofuroxanate | 44.0% |
| Tetrazene | 9.0% |
| Glass powder | 20.0% |
| Nitrocellulose ball powder | 22.0% |
| Adhesin | 2.9% |
| Boron | 2.0% |
| Boron nitride | 0.1% |

All the ignition charges mentioned in the examples were produced moistened with water by kneading and extruded through perforated plates and packed water-moist in cartridges for bolt apparatuses (calibre 6.8×11). The ignition charge was then centrifuged into the edge region.

In order to evaluate the example mixtures propellant cartridges for bolt apparatuses were produced and compared with commercially available cartridges with lead-containing ignition charges as regards ignition sensitivity, tamping performance and contamination of the bolt apparatuses. Bolt apparatuses from the Hilti company, types DX A40 and DX 36, were used.

The results are shown in Table 1.

TABLE 1

| | Ignition sensitivity at a drop height of 300 mm Number of ignitions out of n = 20 | Driving efficiency in steel plate (ST37) Penetration depth (mm) Mean value from 15 tampings Cartridge strength "green" | Contamination after 20 tampings Weight increase in piston and piston guide (mg) Cartridge strength "white" |
|---|---|---|---|
| Comparison cartridge | 20 | 10.4 | 195 |
| Example 1 | 20 | 11.0 | 90 |
| Example 2 | 20 | 10.8 | 85 |
| Example 3 | 20 | 10.7 | 180 |
| Example 4 | 20 | 10.8 | 142 |
| Example 5 | 20 | 10.8 | 64 |
| Example 6 | 20 | 10.8 | 96 |

The results show that the ignition charges function reliably even without any oxidising agent. The results show furthermore that just by omitting the oxidising agent there is less contamination of the bolt apparatus without any reduction in the functional capability of the bolt apparatus. In particular the results show that in the presence of boron and/or boron nitride the contamination in the bolt apparatus is significantly less, without any decrease in the functional capability of the bolt apparatus.

The invention claimed is:

1. A lead-free and barium-free ignition charge, comprising a boron component, one or more initial explosive substances, one or more sensitisers, an auxiliary substance, one or more friction agents, and a binder, and the ignition charge being free from oxidising agents, wherein the boron component is at least one selected from the group consisting of boron and boron nitride, and the proportion of the boron component in the ignition charge is 0.01 to 5 wt. %, wherein the one or more initial explosive substances is at least one selected from the group consisting of diazodinitrophenol, potassium dinitrobenzofuroxanate, and 1-(2,4,6-trinitrophenyl)-5-(1-(2,4,6-trinitrophenyl)-1H-tetrazol-5-yl)-1H-tetrazole, and the proportion of the one or more initial explosive substances in the final ignition charge is 30 to 70 wt. %, wherein the one or more sensitisers is at least one selected from the group consisting of tetrazene and diazodinitrophenol, and the proportion of the one or more sensitisers in the final ignition charge is 1 to 12 wt. %, wherein the auxiliary substance includes nitrocellulose ball powder, and the proportion of the auxiliary substance in the final ignition charge is 2 to 45 wt. %, wherein the one or more friction agents is at least one selected from the group consisting of glass beads and glass powder, and the proportion of the friction agent in the final ignition charge is 10 to 40 wt. %, and wherein the binder includes adhesin, and the proportion of the binder in the final ignition charge is 0.2% to 5%.

2. The lead-free and barium-free ignition charge according to claim 1, wherein the proportion of the boron component in the ignition charge is 0.1 to 2.5 wt. %.

3. The lead-free and barium-free ignition charge according to claim 1, wherein the proportion of the one or more initial explosive substances in the final ignition charge is 35 to 65 wt. %.

4. The lead-free and barium-free ignition charge according to claim 1, wherein the proportion of the one or more initial explosive substances in the final ignition charge is 38 to 58 wt. %.

5. The lead-free and barium-free ignition charge according to claim 1, wherein a sensitiser of the one or more sensitizers is tetrazene.

6. The lead-free and barium-free ignition charge according to claim 1, wherein the proportion of the one or more sensitizers in the final ignition charge is 2 to 10 wt. %.

7. The lead-free and barium-free ignition charge according to claim 1, wherein a friction agent of the one or more friction agents is glass powder.

8. The lead-free and barium-free ignition charge according to claim 1, wherein the proportion of the friction agent in the final ignition charge is 20 to 35 wt. %.

9. The lead-free and barium-free ignition charge according to claim 1, wherein the boron component is boron nitride.

10. The lead-free and barium-free ignition charge according to claim 1, wherein the boron component is contained in a stoichiometric amount with respect to the formation of alkali metal and/or alkaline-earth metal borates in the combustion residues.

11. The lead-free and barium-free ignition charge according to claim 1, further comprising one or more additives including one or more reducing agents, one or more secondary explosives and/or one or more smell-improving substances, or mixtures of two or more of these substances.

12. The lead-free and barium-free ignition charge according to claim 1, further comprising a reducing agent containing aluminium, titanium, titanium hydride, zirconium, zirconium hydride, silicon, graphite, activated charcoal, carbon black or mixtures of two or more of these substances, and the proportion of the reducing agent in the final ignition charge is 0 to 20 wt. %.

13. The lead-free and barium-free ignition charge according to claim 1, further comprising a reducing agent containing aluminium, titanium, titanium hydride, zirconium, zirconium hydride, silicon, graphite, activated charcoal, carbon black or mixtures of two or more of these substances, and the proportion of the reducing agent in the final ignition charge is 1 to 19 wt. %.

14. The lead-free and barium-free ignition charge according to claim 1, wherein the proportion of the auxiliary substance in the final ignition charge is 5 to 40 wt. %.

15. The lead-free and barium-free ignition according to claim 1, wherein the proportion of binder in the final ignition charge is 0.5 to 3 wt. %.

16. The lead-free and barium-free ignition charge according to claim 1, further comprising a secondary explosive containing hexogen, octogen, nitropenta or mixtures of two or more of these substances, and the proportion of the secondary explosive in the final ignition charge is 0 to 20 wt. %.

17. The lead-free and barium-free ignition charge according to claim 1, further comprising a secondary explosive containing hexogen, octogen, nitropenta or mixtures of two or more of these substances, and the proportion of the secondary explosive in the final ignition charge is 1 to 19 wt. %.

18. The lead-free and barium-free ignition charge according to claim 1, further comprising vanillin as a smell-improving substance, and the proportion of vanillin in the final ignition charge is 0 to 10 wt. %.

19. The lead-free and barium-free ignition charge according to claim 1, further comprising vanillin as a smell-improving substance, and the proportion of vanillin in the final ignition charge is 0.1 to 9 wt. %.

20. The lead-free and barium-free ignition charge according to claim 1, wherein the proportion of the friction agent in the final ignition charge is 20 to 32 wt. %.

21. The lead-free and barium-free ignition charge according to claim 1, further comprising a reducing agent containing aluminium, titanium, titanium hydride, zirconium, zirconium hydride, silicon, graphite, activated charcoal, carbon black or mixtures of two or more of these substances, and the proportion of the reducing agent in the final ignition charge is 5 to 15 wt. %.

22. The lead-free and barium-free ignition charge according to claim 1, wherein the proportion of the auxiliary substance in the final ignition charge is 9 to 36 wt. %.

23. The lead-free and barium-free ignition charge according to claim 1, further comprising a secondary explosive containing hexogen, octogen, nitropenta or mixtures of two or more of these substances, and the proportion of the secondary explosive in the final ignition charge is 5 to 15 wt. %.

24. The lead-free and barium-free ignition charge according to claim 1, further comprising vanillin as a smell-improving substance, and the proportion of vanillin in the final ignition charge is 1 to 5 wt. %.

* * * * *